US008387795B1

(12) United States Patent
Rogers et al.

(10) Patent No.: US 8,387,795 B1
(45) Date of Patent: Mar. 5, 2013

(54) COMBINED BEVERAGE LID PLUG AND BOOKMARK

(76) Inventors: Donald Scott Rogers, Lafayette, LA (US); Billy James McDonald, Lafayette, LA (US); Andy Paul Todd, Lafayette, LA (US); Aimee Elizabeth Todd, Lafayette, LA (US)

( * ) Notice: Subject to any disclaimer, the term of this patent is extended or adjusted under 35 U.S.C. 154(b) by 0 days.

(21) Appl. No.: 13/243,566

(22) Filed: Sep. 23, 2011

(51) Int. Cl.

| | |
|---|---|
| ***B65D 3/22*** | (2006.01) |
| ***B65D 51/18*** | (2006.01) |
| ***G09F 3/00*** | (2006.01) |
| ***B42D 9/00*** | (2006.01) |
| ***A47G 19/22*** | (2006.01) |

(52) U.S. Cl. ..... 206/459.5; 40/324; 116/237; 220/713; 281/42

(58) Field of Classification Search ..... 206/459.1, 206/459.5; 40/306, 311, 324; 116/234–239; 220/254.1, 712, 713; 281/42, 45
See application file for complete search history.

(56) References Cited

U.S. PATENT DOCUMENTS

| | | | | |
|---|---|---|---|---|
| 1,193,421 | A * | 8/1916 | Prettyman | 281/42 |
| 1,486,789 | A * | 3/1924 | Nickel | 40/324 |
| 1,790,649 | A * | 2/1931 | Baumgarten | 281/42 |
| 3,143,998 | A * | 8/1964 | Madden | 116/238 |
| 3,159,137 | A * | 12/1964 | Baldwin | 116/237 |
| 4,838,198 | A * | 6/1989 | Knox | 116/239 |
| 7,530,186 | B2 * | 5/2009 | Kaliner | 40/324 |
| 8,052,003 | B2 * | 11/2011 | Burns | 220/713 |
| 2005/0284874 | A1 * | 12/2005 | Lucks | 220/712 |
| 2007/0023442 | A1 * | 2/2007 | Auzenne | 220/801 |
| 2011/0109074 | A1 * | 5/2011 | Lee | 281/42 |

* cited by examiner

*Primary Examiner* — Bryon Gehman

(57) ABSTRACT

A combined beverage lid plug and bookmark is disclosed. The beverage lid plug and bookmark has an elongated bookmark section, a plug section configured to be received into an opening in a beverage container lid, and a flexible bookmark tab. The beverage lid plug and bookmark has a banner section for display of desired advertising.

11 Claims, 2 Drawing Sheets

COMBINED BEVERAGE LID PLUG AND BOOKMARK

FIELD OF THE INVENTION

This invention relates generally to disposable beverage containers and lids, and more particularly to a combined beverage lid plug and bookmark.

BACKGROUND OF THE INVENTION

Disposable beverage cups and lids are commonly utilized in restaurants and coffee shops for use as take-out containers for hot beverages such as coffee and tea. The lids for these containers sometimes are provided with openings and plugs to resist spillage of the contained beverage. These plugs may be integrated with the container lid or they may be provided as separate plugs to fit the lid.

While these separate container plugs are typically designed to serve only one function, that of plugging the container lid, some such plugs have been presented and configured in different embodiments to provide additional functionality such as an integrated stirring tool, an integrated container for drink additives such as sugar and cream, and as placard for advertisement. However, the current plug devices do not have a function beyond the scope of use with the beverage and beverage container.

SUMMARY OF THE INVENTION

The presented design expands the scope and usefulness of the plug closure device by providing an integrated bookmark to increase its functionality beyond that of the beverage and beverage container. The addition of the integrated bookmark to the beverage plug increases the potential life of the product. While increased life is important from a social and environmental standpoint, the most advantage is gained in the device's potential for continued advertisement.

Because the combined beverage plug and bookmark may be used even after consumption of the beverage for which it was utilized, the time the user is exposed to the advertisement displayed on the beverage plug and bookmark is expanded from the period of beverage consumption to the time it takes to read a book or magazine. Additionally there is the chance the user may retain the device for future use. The combined beverage plug and bookmark is of particular suitable for use in cafes and coffee shops that incorporated into bookstores or other restaurants that provide an environment conducive to reading.

DESCRIPTION OF THE EMBODIMENT

Figure 1:
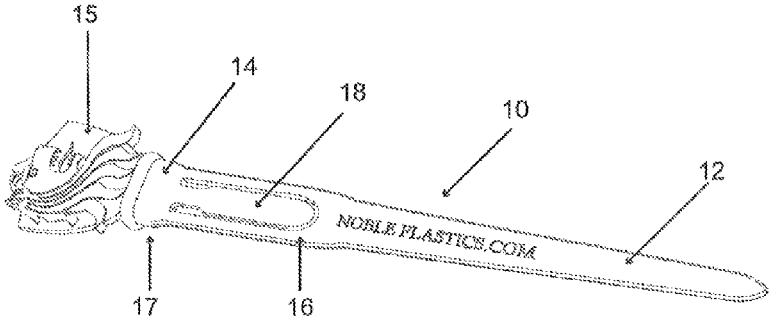
FIG. 1 is a perspective view of the combined beverage lid plug and bookmark.
Figure 2:
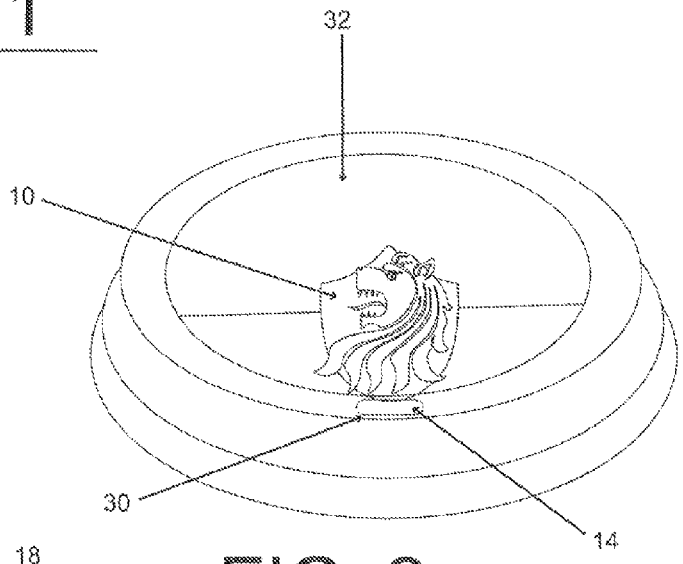
FIG. 2 is a perspective view of a typical beverage lid with which the combined beverage lid plug and bookmark of FIG. 1 may be utilized.

FIG. 1 shows a perspective view of the combined beverage lid plug and bookmark (10). The combined beverage lid plug and bookmark (10) is comprised of an elongated bookmark section (12) that extends longitudinally from an integrated attached plug section (14). The elongated bookmark section (12) is configured with slit opening (16) to create a flexible bookmark tab (18). The plug section (14) has a tapered plug (17) that is configured to be received into an opening (30) of a beverage container lid (32) such as that shown in FIG. 2.

The plug section (14) and tapered plug (17) and corresponding container opening (30) are shown merely for illustration purposes. It will be understood that the plug section (14) and tapered plug (17) may be configured to accommodate any suitable container opening (30). It is thought that the combined beverage lid plug and bookmark (10) may be made of plastic because of its low cost and ease of manufacture.

Figure 3:
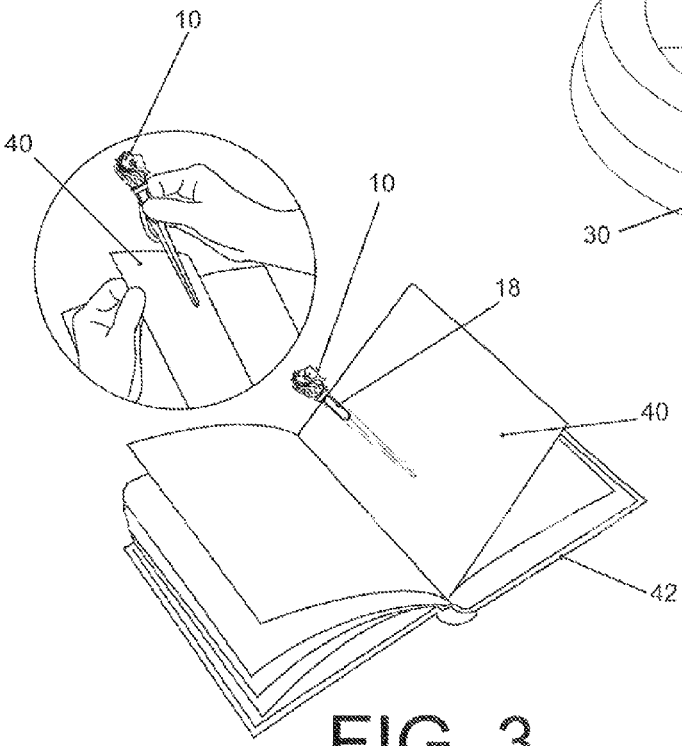
FIG. 3 is illustration the combined beverage lid plug and bookmark in use as a bookmark.

As shown in FIG. 3, the combined beverage lid plug and bookmark (10) may be utilized as a bookmark. This is accomplished by inserting the flexible bookmark tab (18) of the combined beverage lid plug and bookmark (10) between as page (40) of a book (42). The flexibility of the bookmark tab (18) will serve to retain the combined beverage lid plug and bookmark (10) on the page (40). This use as a bookmark will encourage continued use of the of the combined beverage lid plug and bookmark (10) long after the beverage with which it was first utilized or presented is consumed.

The elongated bookmark section (12) of combined beverage lid plug and bookmark (10) may also be used for stirring a beverage. This stirring application will provide additional usefulness to the combined beverage lid plug and bookmark (10).

Figure 4:
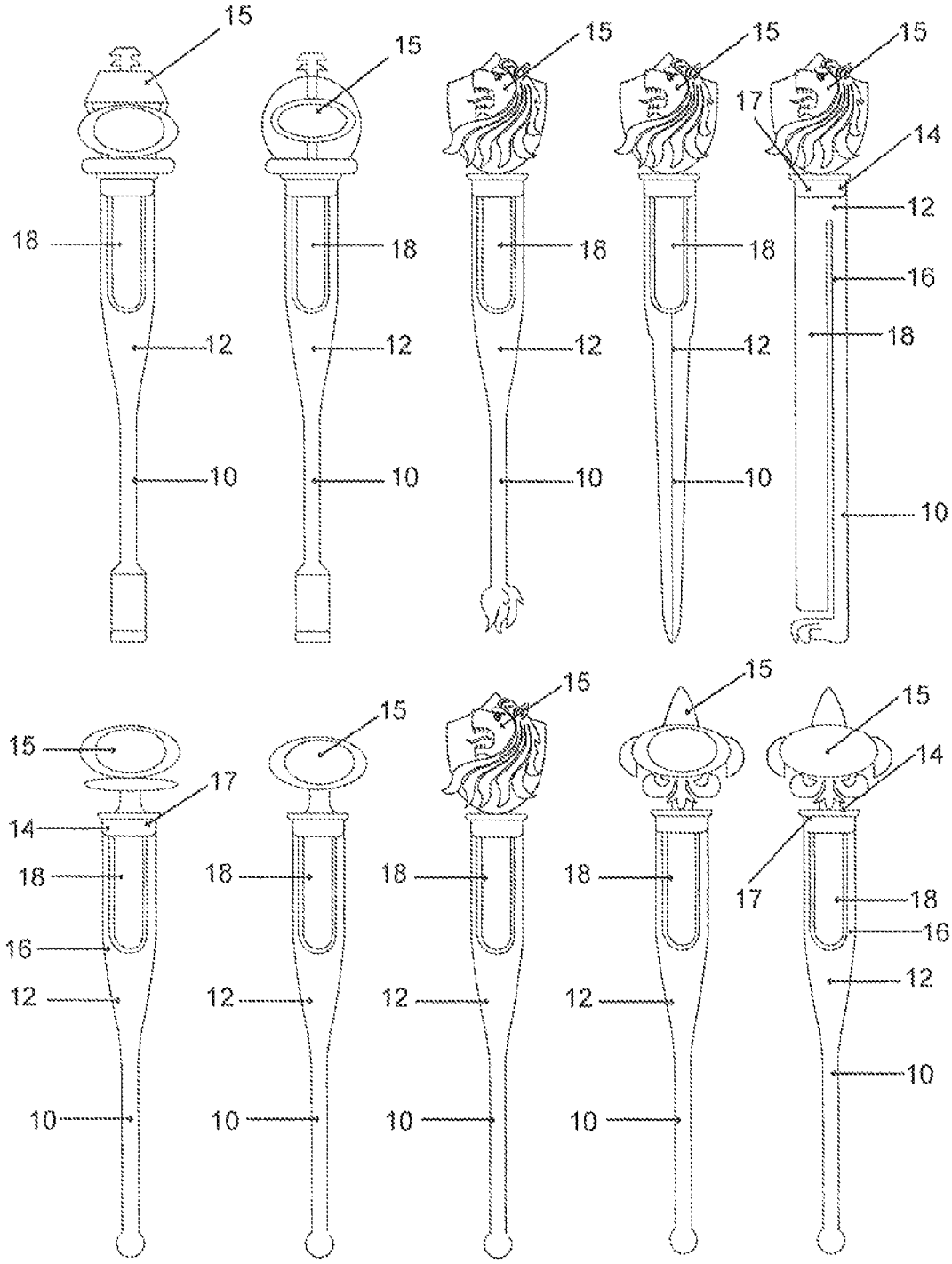
FIG. 4 presents illustrative examples of alternate embodiments of the combined beverage lid plug and bookmark of FIG. 1

Because the anticipated continued use of the combined beverage lid plug and bookmark (10) as a bookmark, it may be configured with a banner (15) as shown in FIG. 1. This banner (15) may contain a logo as shown or present a field for the presentation of advertising. As shown in FIG. 4, the banner (15) and the bookmark section (12) of the combined beverage lid plug and bookmark (10) may have a variety of configurations as desired.

As an alternative, the combined beverage lid plug and bookmark (10) might also be configured with the slit opening (16) and the flexible bookmark tab (18) positioned in the banner (15). When so configured, the elongated bookmark section (12) may be utilized as the field for the presentation of advertising. Placing the slit opening (16) and the flexible bookmark tab (18) in the banner (15) would allow more room for advertising.

The present invention can be seen from the foregoing description to provide a combined beverage lid plug and bookmark and a method of its use. It is thought that the apparatus and method of the present invention and many of its attendant advantages will be understood from the foregoing description. It is also thought that it will be apparent that various changes may be made in the form, construction and arrangement of the parts of the apparatus and method without departing from the spirit and scope of the invention or sacrificing all of its material advantages.

We claim:

1. In the combination of a beverage container containing a beverage and a beverage container lid, said beverage lid having an opening for dispensing the beverage from the beverage container, an apparatus for plugging a beverage lid opening comprising:

a) a plug section, said plug section being configured to engage with the dispensing opening in the container lid whereby engagement of said plug section into the dispensing opening will close said dispensing opening and whereby spillage of said contained beverage is resisted;

b) an integrated elongated bookmark section, said bookmark section attached to and extending longitudinally from said plug section whereby said elongated bookmark section may be inserted into said beverage for stirring; and c) a flexible bookmark tab.

2. The apparatus for plugging a beverage lid opening as recited in claim 1 wherein said elongated bookmark section has a slit opening around said flexible bookmark tab whereby a page of a book may be inserted into said slit opening and thereby attaching said bookmark section to the page.

3. The apparatus for plugging a beverage lid opening as recited in claim 2, further comprising a banner section.

4. The apparatus as recited in claim 3, wherein said banner section is configured to contain advertising.

5. The apparatus as recited in claim 4, wherein said apparatus is made of plastic.

6. A combined beverage lid plug and bookmark apparatus comprising:

a) a tapered plug section configured to engaging with a dispensing opening on a lid of a beverage container, the container retaining a beverage, whereby engagement of said tapered plug section into the dispensing opening will close the dispensing opening thereby resisting spillage of the retained beverage;

b) an elongated longitudinally extending bookmark section, said bookmark section attached to and integrated with said tapered plug section whereby the retained beverage may be stirred with said elongated bookmark section;

c) a flexible bookmark tab, said flexible bookmark tab being formed by a slit opening in said elongated bookmark section whereby inserting a page of a book into said slit opening will thereby attach said bookmark section to the page; and d) a banner section, said banner section displaying desired advertising.

7. The apparatus as recited in claim 6, wherein said apparatus is made of plastic.

8. A method for using a combined beverage lid plug and bookmark comprising the steps of:

a) providing a lid plug and bookmark having an elongated bookmark section, a plug section, and a flexible bookmark tab;

b) inserting said plug section of said lid plug and bookmark into an opening in a lid of a beverage container;

c) removing said plug section of said lid plug and bookmark from said opening in said lid of said beverage container; and d) inserting said flexible bookmark tab on a page of a book.

9. The method as recited in claim 8, including the additional step of providing said lid plug and bookmark with a banner section, said banner section configured with desired advertising.

10. The method as recited in claim 9, further comprising the step of stirring a beverage with said elongated bookmark section.

11. The method as recited in claim 9, wherein said flexible bookmark tab is created by providing a slit opening in said elongated bookmark section.

* * * * *